United States Patent [19]

Dibble et al.

[11] 4,409,071

[45] Oct. 11, 1983

[54] MASKING FOR SELECTIVE ELECTROPLATING JET METHOD

[75] Inventors: Eric P. Dibble, Endicott; Thomas E. Lynch, Vestal, both of N.Y.

[73] Assignee: International Business Machines Corporation, Armonk, N.Y.

[21] Appl. No.: 453,034

[22] Filed: Dec. 27, 1982

[51] Int. Cl.[3] ..... C25D 5/02; C25D 7/06

[52] U.S. Cl. ..... 204/15; 204/27

[58] Field of Search ..... 204/15, 27

[56] References Cited

U.S. PATENT DOCUMENTS 3,178,305 4/1965 Ward ..... 204/15

4,364,801 12/1982 Salama ..... 204/15

OTHER PUBLICATIONS

"High-Speed Selective Electroplating with Single Circular Jets", R. C. Alkire et al., Journal of the Electrochemical Society, vol. 129, No. 11, Nov. 1982, pp. 2424–2432.

*Primary Examiner*—T. M. Tufariello

*Attorney, Agent, or Firm*—Norman R. Bardales

[57] ABSTRACT

A low conductivity fluid mask in a predetermined fluid state is used as a mask in an electroplating jet system method. Preferred embodiments describe a deionized water mask in the liquid fluid state.

11 Claims, 9 Drawing Figures

MASKING FOR SELECTIVE ELECTROPLATING JET METHOD

BACKGROUND OF THE INVENTION

1. Field of the Invention

This invention relates to a method for selective electroplating with an unsubmerged jet, and more particularly to masking improvements therefor.

2. Description of the Prior Art

The principles of electroplating with an unsubmerged jet and its concomitant advantages of selective electroplating and high speed are well known in the art, cf., for example, the publication entitled "High-Speed Selective Electroplating with Single Circular Jets", R. C. Alkire et al, Journal of the Electrochemical Society, Vol. 129, No. 11, November 1982, pages 2424–2432.

Briefly, in these systems, a jet of electroplating solution is discharged from a nozzle and impinges on the region of the workpiece to be plated. The jet is discharged unsubmerged, that is to say, the jet when emerging from the nozzle passes through a medium, e.g. air, that is extremely less viscous than that of the electroplating solution. Such jet systems are referred to in the art, and as used herein, as a free or unsubmerged jet system to distinguish them from other jet systems where the jet is discharged into a surrounding medium which is the same as the plating solution, the latter being known and referred to in the art as a submerged jet system. The free or unsubmerged jet thus provides an electric current path between the anode of the system, which is located upstream in the nozzle, and the external workpiece, which is the system's cathode. As a result, electrodeposition takes place on the workpiece at the impingement region and surrounding vicinity of the workpiece in a selective and high speed manner.

Moreover, as explained in the aforementioned publication, the customary case, particularly in commercial systems, is to direct the jet at the workpiece region where the plating is to take place without any masking. On the otherhand, in the case where masking is used in the prior art of which we are aware, these masks have been solids. However, in both of the aforementioned cases, i.e. the unmasked case and the solid mask case, there are certain attendant problems, disadvantages and/or deleterious effects associated with each case.

For example, in the unmasked case, extraneous electroplating solution resulting from such things as runoff of the electroplating solution or splashing of the solution from the impinging jet causes some of the plating material to be electrodeposited on parts of the workpiece not desired or required to be plated. As a result, in the prior art not only was the material plated to the region of interest but it also became plated to other regions which were not of interest. The plating on the regions, which were not of interest, is sometimes referred to herein as background plating. This background plating is often detrimental to the function or the aesthetics of the plated regions of interest of the workpiece such as, for example, in the fabrication of selectively plated high precision electrical components or of selectively plated ornamental objects such as costume jewelry or the like. Moreover, in the unmasked case, there was a concomitant wastage of the plating material as a result of it being plated to the unwanted, i.e. the not-of-interest, regions. The wastage thereby increased the cost of the process and the ultimate product and which can be quite substantial if the particular material being electrodeposited happens to also be a precious metal such as gold or the like. Even in those situations where it is desirable and practical to reclaim the plated material from the unwanted regions, it nevertheless adds to the complexity and cost of the overall process for fabricating the resultant work product.

Likewise, in the case of the solid mask, it too also adds to the cost and complexity of the electroplating process per se and the overall fabrication process in general. In the solid mask case, the additional costs and complexity are associated with the making, applying and/or subsequent stripping of the mask. Moreover, the solid mask is not always easily or able to be applied and/or removed and this is particularly true where there are hard to reach or inaccessible regions of the workpiece that are desired to be masked.

SUMMARY OF THE INVENTION

It is an object of this invention to provide an improved method for selectively electroplating of the kind which uses an unsubmerged jet.

It is another object of this invention to provide a selective electroplating method of the aforementioned kind that is readily implementable, simple and/or relatively inexpensive.

It is still another object of this invention to provide a selective electroplating method of the aforementioned kind which provides masking without the use of solid masks.

It is still another object of this invention to provide a selective electroplating method of the aforementioned kind which provides dynamic masking.

Still another object of this invention is to provide a selective electroplating method of the aforementioned kind in which the masking provides multiple functions and/or combines a masking function with one or more of the following functions, to wit: rinsing, reclamation, or recycling.

According to one aspect of the present invention, a method for selectively electroplating a workpiece by an unsubmerged jet of plating solution is provided by electroplating a selected region of the workpiece by impinging the jet on the selected region, and concurrently providing a low conductivity layer in a predetermined fluid state on the workpiece adjacent to the selected region to mask the workpiece adjacent to the selected region from the electroplating solution.

According to another aspect of the inventive method, the aforementioned low conductivity layer is further contiguous over the selected region in the absence of the impinging jet, and the jet when present pierces the layer to expose the region for the impinging and the electroplating thereof.

According to still other aspects of the inventive method, the aforementioned low conductivity layer is continuously flowing on the workpiece adjacent to the selected region, and/or the fluid state of the layer is liquid, and/or the layer is deionized water.

The foregoing and other objects, features and advantages of the invention will be apparent from the more particular description of the preferred embodiments of the invention, as illustrated in the accompanying drawing.

BRIEF DESCRIPTION OF THE DRAWING

In the figures, like elements are designated with similar reference characters.

DESCRIPTION OF THE PREFERRED EMBODIMENTS

Figure 1:
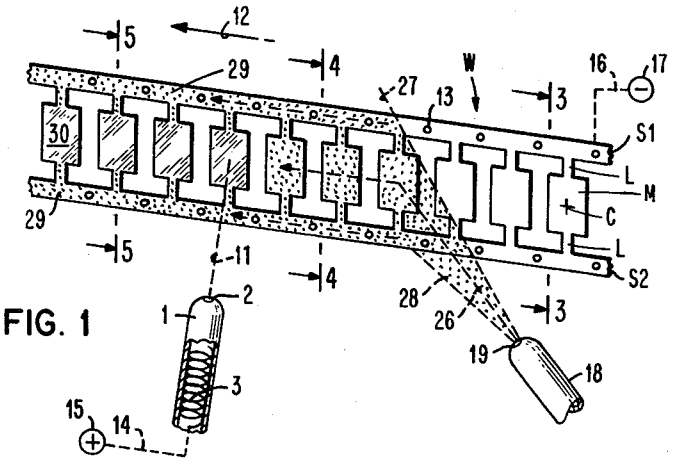
FIG. 1 is a schematic perspective view of a workpiece and apparatus for masking and electroplating the workpiece in accordance with a preferred selective electroplating method embodiment of the present invention.
Figure 2:
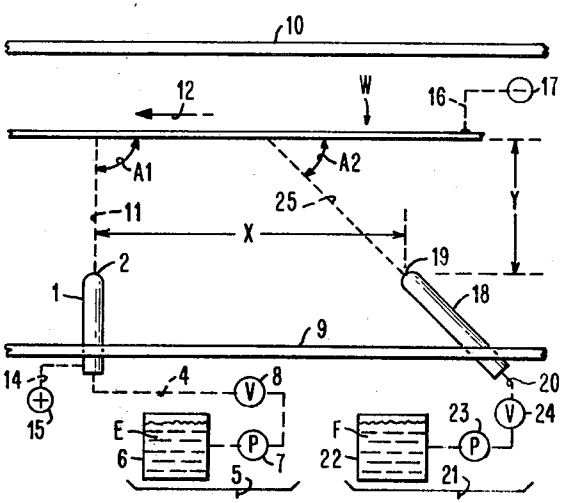
FIG. 2 is a schematic top view of the apparatus of FIG. 1.

Referring to FIGS. 1–2, there is shown schematically by way of example selective plating apparatus for practicing a preferred embodiment of the method of the present invention. For the preferred method embodiment being described with respect to the apparatus of FIGS. 1–2, the workpiece W of FIGS. 1–7 is shown by way of example as an integral conductive piece comprised of a plurality of rectangular planar members M, the upper and lower parallel selvage carrier strips S1 and S2, and the interconnecting links L. Workpiece W and its components M, S1, S2 and L have been previously stamped out from a ribbon roll of planar stock in a manner well known to those skilled in the art.

The apparatus of FIGS. 1–2 has an electroplating jet system of the unsubmerged type or kind that includes an electroplating jet nozzle 1 which has a discharge orifice 2 of a predetermined configuration. Preferably, orifice 2 has a circular configuration of the type that discharges the jet in a cylindrical shape. Located upstream in the hollow nozzle 1 is a helix-shaped electrode 3 which is the electroplating anode. The nozzle 1 is connected by appropriate schematically shown tubing 4, FIG. 2, or the like to a supply 5 of electroplating solution E, i.e. the electrolyte, and which supply 5 includes the electrolyte supply tank 6 and appropriate pump 7 and valve 8.

The nozzle 1 is mounted in the front wall 9 of the electroplating process cell, of which only the aforementioned front wall 9 and the parallel rear wall 10 are shown in FIG. 2 for sake of clarity. The mounting is such that the nozzle 1 extends through wall 9 into the cell with its center axis 11 aligned at a predetermined angle A1 with respect to the plane of workpiece W, angle A1 being preferably 90 degrees, i.e. normal to the plane of workpiece W as shown in FIGS. 1–2. Moreover, the center axis 11 is aligned to intersect the locus defined by the centers C of members M as they are carried in the direction indicated by arrow 12, hereinafter sometimes referred to as simply as direction 12.

The workpiece W is moved in direction 12 through appropriate openings, not shown, in the side walls, not shown, of the cell by the coaction of the indexing holes 13 of selvage strips S1, S2 and suitable coacting external indexing means, not shown, such as non-conductive pins or the like in a manner well known to those skilled in the art. The tubing 4, as well as the connections thereto, and the supply 5 are also external to the cell, as are the electrical connection 14 between the positive terminal 15 of an external adjustable electroplating power supply, not shown, and anode 3. In a similar manner, the other electroplating electrode or cathode, which is the workpiece W, is connected by an external electrical connection 16 to the negative terminal 17 of the aforementioned power supply. For sake of clarity, connection 16 is shown schematically in phantom outline in FIGS. 1–2, it being understood that connection 16 includes, for example, one or more conductive brushes or rollers, not shown, in contact with one or both of the strips S1 or S2 outside of the electroplating cell, cf. connection 16 and strip S1.

Also provided with the apparatus of FIGS. 1–2 is an electroplating masking system which includes a nozzle 18 with a discharge orifice 19. The nozzle 18 is connected through tubing 20 to an external supply 21 of a low conductivity fluid F in predetermined fluid state. In the preferred method embodiment, fluid F is deionized water and is in the liquid state. Supply 21 includes supply tank 22 for the fluid F, and the pump 23 and valve 24.

The nozzle 18 is positioned upstream from the nozzle 1 relative to the direction of arrow 12 and is mounted in the front wall 9 of the plating cell. Preferably, the nozzle 18 is inclined at an angle A2 with the plane of the workpiece W such that, when the fluid F is discharged from the opening 19 and its discharge intercepts the workpiece W, the fluid F from the discharge flows along the workpiece W in substantially the same direction 12 as the movement of the workpiece W.

It is also preferred that nozzle 18 is of the type that provides a flat discharge configuration that flares outwardly from the opening 19. It is further preferred that nozzle 18 is mounted in the wall 9 such that the plane 25 of the flat discharge is inclined to the plane of the workpiece W at an angle A2 of 45 degrees, that the line of intersection formed between the plane 25 and the aforementioned plane of workpiece W is substantially at right angles to the direction 12, and that the center axis 26 of the discharge is aligned to substantially intersect the aforementioned locus defined by the centers C of members M as they move thereby with the top and bottom edges of the strips S1 and S2 being disposed symmetrically between the corresponding top and bottom edges 27 and 28, respectively, of the discharge.

For purposes of explanation, it is assumed that the selective electroplating of the particular workpiece W of FIGS. 1–2 is desired to substantially occur exclusively on the frontal surface regions of its members M which are in facing relationship with nozzle 1. Now, in accordance with the principles of the present method invention, the method provides the selective electroplating by impinging the unsubmerged electroplating jet from nozzle 1 on the selected frontal surface region of the particular member M, and concurrently providing a low conductivity fluid layer 29 of the fluid F on the workpiece W adjacent to the selected frontal surface region of the particular member M to mask the workpiece W adjacent to the selected region from the electroplating solution, cf. FIGS. 1, 5 and 7. The layer 29, because of its low conductivity layer, acts as a high resistance barrier to the electroplating current carried by the jet of electroplating solution. As a result, layer 29 substantially inhibits any electroplating reaction between the jet and/or any electroplating solution which becomes entrapped therein and the underlying portions of the workpiece masked thereby.

Figure 6:
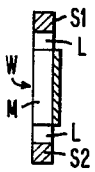
FIG. 6 is a side elevation of the workpiece of FIG. 1 after the selective electroplating has been completed and the fluid mask is removed.

In addition to providing the electroplating masking function, the fluid layer 29 also provides a carrier function for carrying off the electroplating solution runoff and thereby facilitates the recycling of the electroplating solution runoff and/or reclaiming of the plating material thereof. Recycling of the electroplating runoff from the carrier fluid F can be achieved simply, for example, by subsequent evaporation of the Fluid F. Furthermore, the present invention substantially mitigates and/or obviates background plating and hence mitigates and/or obviates the stripping thereof from the workpiece, i.e the reclaiming thereof, as was done in the prior art. Moreover, the plating mask layer 29 is readily removable by conventional draining and/or drying processes such as, for example, hot air drying, evaporation, etc., leaving the workpiece W as shown in FIG. 6. While, the invention can be practiced using a static layer 29 on the workpiece W adjacent to the particular region being electroplated, in the preferred embodiment, the layer 29 is preferred to the dynamic so as to be continuously flowing on the workpiece W adjacent to the particular region.

Figure 5:
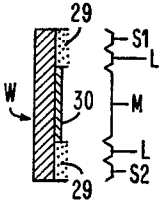
FIGS. 3–5 are side elevation views of the workpiece of FIG. 1 taken along the lines 3—3, 4—4, and 5—5, respectively, thereof and illustrating various stages of the workpiece being processed by the apparatus of FIG. 1.
Figure 4:
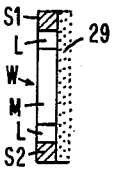
Figure 7:
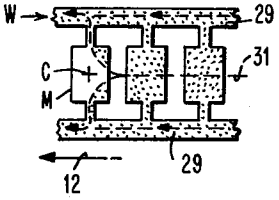
FIG. 7 is a front view of the workpiece of FIG. 1 illustrating schematically the piercing of the fluid mask by the electroplating jet and direction of fluid mask flow on the workpiece adjacent to the region of the workpiece being selectively plated.

Furthermore, for either the static or dynamic case of layer 29, it is also preferred that the layer 29 is contiguous over the selected frontal surface region M in the absence of the impinging electroplating jet, cf. of FIG. 4, and the electroplating jet when present pierces the layer 29 to expose the region M for the impinging and the electroplating thereof, cf. FIGS. 5 and 7. These as well as other aspects of the present invention will be explained in greater detail in connection with the following operational description of the apparatus of FIGS. 1–2 herein next presented.

Figure 3:
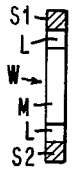

As aforementioned, for the preferred embodiment, the fluid layer 29 is deionized water F and is preferably in its liquid state. For the preferred operational mode, the workpiece W is indexed in the electroplating cell at a continuous or intermittent rate of feed, the rate of feed, and/or dwell time in the case where an intermittent rate is used, being correlated with the plating process parameters for producing a plating layer of a desired thickness. As such, prior to any member M of the workpiece W being advanced to the position where it is intercepted by the deionizing water discharge from nozzle 18, the workpiece W is bare as shown in FIG. 3.

When a particular member M arrives at the deionized water discharge, the deionized water F provides a continuously moving layer 29 thereof which is conformally contiguous over the selected region M and adjoining links L and carrier strips S1 and S2, as shown in FIG. 4. It should be noted that the layer 29 is also contiguous on the carrier strips S1 and S2 between adjacent members M and their particular links L. It should also be noted that the layer 29 at this time begins its masking function and is also at this time performing a pre-rinse function of the member M which thereby aids in the subsequent electroplating deposition.

Next, the particular masked member M is indexed towards and intercepts the jet of electroplating solution E from nozzle 1, whereupon in the preferred method embodiment the jet pierces the deionized water layer 29 overlying the member M and thereby exposes and impinges the underlying surface region of the member M, cf. FIGS. 1, 5 and 7. As a result, electrodeposition of the plating material in the solution E is deposited as a layer 30 on the frontal surface region of member M. Concurrently, the now so pierced deionized layer 29 in the preferred method embodiment continues to flow adjacently on the workpiece W on both sides of the surface region M in a pattern represented by the flow pattern 31 in FIG. 7. Concurrently, layer 29 substantially masks the parts of workpiece W, which are not of interest, to wit: the members S1, S2 and L, and are not desired to be background plated with the plating material that are the result of such things as, for example, splashing or runoff of the plating solution as would be the case if they were not masked.

Moreover, in the case of the preferred dynamic layer 29 in which the layer 29 is continually kept flowing on the workpiece W adjacent to the selected frontal surface region of the particular member M being electroplated, the flow movement of the dynamic layer 29 of the preferred embodiment further enhances the aforedescribed masking function of the layer 29. More particularly, as a result of the flow movement, layer 29 is continuously replenished with fresh fluid. As such, the desired low conductance characteristic of the fluid mask layer 29 is not substantially compromised because concentration and/or saturation of the layer 29 by the extraneous plating material which becomes entrapped therein is mitigated and/or prevented by the flow movement as the layer 29 is continuously being moved away from the masked workpiece W surrounding the selected region being plated and is being replaced with fresh fluid F. The flowing movement also enhances the aforementioned carrier function because it continuously carries off the plating solution runoff and hence also results in enhancement of the aforementioned recycling and/or reclamation functions.

Figure 8:
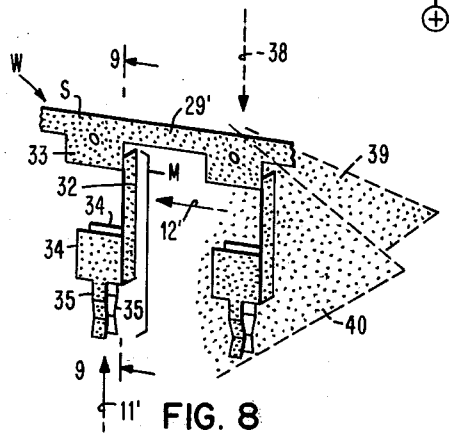
FIG. 8 is a partial schematic perspective view of another workpiece and alternate modifications of the apparatus of FIGS. 1–2 for masking and electroplating the last mentioned workpiece in accordance with the aforementioned preferred method embodiment as well as another preferred method embodiment of the present invention.
Figure 9:
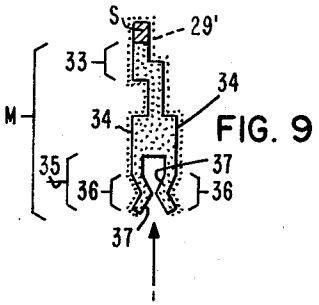
FIG. 9 is a cross section of the workpiece of FIG. 8 taken along the line 9—9 thereof illustrating the fluid mask thereon.

Referring now to FIGS. 8–9, there is shown for purposes of explanation another conductive workpiece W', e.g. copper or a copper alloy such as, for example, Be(2%)-Cu(98%). The workpiece W' includes a plurality of members M' integrally depending from a single selvage strip S. Each member M' is to be an electrical component to wit: a connector, and has an elongated stem 32 connected at one side of its upper end and at a right angle to the rectangular shaped part 33 of strip S. Two rectangular shaped parallel parts 34 are connected at right angles to the stem 32 at its lower end. Depending from the bottoms of the parts 34 are aligned elongated extensions 35 shaped at their lower ends 36 to form a pair of female electrical spring contacts. The members M' after being plated, as hereinafter described, are removed from the selvage strip S and individually inserted in one of the plated conductive vias of a printed circuit board, not shown, or the like by inserting the aforementioned upper end of the stem 32 into the via and solder bonding the stem 32 to the plated walls of the via in a manner well known to those skilled in the art. As a result, the member M is mounted to the board and the protruding extensions are ready to receive between its contacts 35 a compatible male contact, not shown, such as, for example, one of the input/output pins of a pluggable integrated circuit module, not shown, or other type of slidable male contact. The workpiece W' is stamped out of a roll of planar stock and bent into the aforedescribed shape in a manner well known to those skilled in the art. The inner frontal surfaces 37 of the lower ends 36 are to be plated, as explained hereinafter, in accordance with the principles of the present invention. The particular plating material is selected to have good electrical and high wear resistant properties so as to improve the electrical contact and life of the contact surfaces 37. Preferably, the plating material is gold, in which case the contact surfaces 37 are first treated for diffusion enhancement of the gold to the copper or copper alloy by, for example, by plating them with Ni, prior to the plating of the gold as is well known to those skilled in the art. The diffusion layer plating, i.e. the Ni, may be plated to the entire workpiece W' or alternatively may be selectively electroplated to the contact surfaces 37 using the principles of the present invention in a manner similar to the way the gold is selectively plated to the surfaces 37 as is next described.

For sake of clarity, the electroplating jet and masking system apparatus is omitted in FIGS. 8–9. In one embodiment, the low conductivity fluid F, which is preferably deionized water in the liquid fluid state, is applied at the top of the workpiece W' in the direction 38 from a single nozzle, not shown, the plane of the flat discharge of which transverses the center plane located between the two parallel members 34 at right angles in a symmetrical manner. In this direction, i.e. direction 38, the fluid F covers the outer and most of the inner surfaces of the workpiece W' except for the parts of the inner surfaces 37 located on the outwardly flared lower portions of ends 36, the inwardly flared upper portions of ends 36 shielding the last mentioned parts of the surfaces 37.

In an alternative embodiment, the fluid F is applied on opposite sides of the workpiece W' by two symmetrically positioned and inclined nozzles, not shown, which provide the flat sprays 39 and 40, respectively. As such, the fluid F covers the outer surfaces of the workpiece W', but most of the inner surfaces of members 34 and 35 are shielded from the fluid F by their opposing corresponding member and, relative to the direction 12', the leading surface of extension 32 is shielded from the fluid F by the trailing surface of extension 32.

A cylindrical shaped unsubmerged jet, shown schematically by arrow 11', of electroplating solution from a nozzle, not shown, is applied at the bottom of the workpiece W' symmetrically between the two members 36. As a result, after the workpiece W' has been masked with the fluid F and indexed in the direction 12', the inner surfaces 37 of the ends 36 are electroplated by the jet while concurrently a layer 29' of fluid F on the workpiece adjacent to the selected inner surfaces 37 to mask the workpiece adjacent to the surfaces 37 from the electroplating solution. Moreover, in the case of the first mentioned embodiment where the layer 29' results from the application of the fluid F from the direction 38, it should be understood that the parameters of the jet 11' are judiciously selected so that only the layer 29' covering the inner surfaces 37 of the upper ends 36, and if present also on the inner surfaces 37 of the lower ends 36, are pierced by the jet 11'. In a similar manner, if in the case of the other embodiment, if the surfaces 37 should become covered by the layer 29', the jet 11' can be adjusted to pierce the layer 29' to expose only the surfaces 37. It should be understood, however, that in the case of this last mentioned embodiment, the surfaces 37 are normally not covered by the layer 29' and hence there is no piercing by the jet 11' per se, the jet 11' being controlled to confine its impinging and electroplating action on the surfaces 37 while concurrently the layer 29' is masking the workpiece W' adjacent to the surfaces 37.

The present invention is readily implementable in an automated process as can readily be appreciated by those skilled in the art. Moreover, instead of providing the electroplating jet and/or fluid discharge on a continuous basis, the movement of the workpiece through the cell can be synchronized with the on/off cycle of an electrically controlled valve, e.g. valve 8 and/or 24, to further enhance the selective electroplating and/or conserve the electroplating solution and/or masking fluid. Moreover, as contemplated by the present invention, after the plating has taken place in the particular area of interest the plated area may be masked by the fluid layer so as to protect it from additional plating. This can be done, for example, by having the flow of the fluid, which diverges around the area of interest at the jet impinging site to allow the plating action to take place, cf. FIG. 7, to re-converge thereafter over the now plated area. Alternatively, an auxiliary nozzle for discharging the fluid F can be placed downstream of the electroplating jet impinging site. In either case, the build up of further plating is inhibited which is particularly important if a uniform and/or precision plating thickness is required.

By way of example, a workpiece having a configuration similar to that of the workpiece W of FIGS. 1–7 had members M selectively electroplated with gold on their frontal surfaces with apparatus similar to that shown in FIGS. 1–2 in accordance with the principles of the present invention. The bare workpiece W was nickel-plated copper and the members M were approximately 0.100 inch×0.050 inch. A commercially available nozzle fitting of stainless steel or the like was provided with a circular bore of 0.025 inch diameter to discharge the electroplating solution as a cylindrical jet. The fitting was threadably mounted in a cylindrical polypropylene member, which also housed the helix shaped anode formed from platinum wire. A commercially available nozzle fitting of stainless steel or the like with a bore of 0.011 inch diameter provided a flat discharge or spray of the deionized water in the liquid state. The nozzles were mounted in the front transparent wall of an electroplating cell made of appropriate material, e.g. glass, with their discharge orifices substantially coplanar and spaced approximately 1.0 inches from each other along the X axis and approximately 0.25 inches along the Y axis from the workpiece W. Also, the mounting was such that the electroplating jet and deionized water jet were at respective angles A1=90 degrees and A2=45 degrees with the workpiece. An electroplating power supply of 10 to 50 volts DC was used, depending on the speed and quality of the plated layer desired, a preferred range being approximately 20–25 volts DC, the electroplating voltage being correlated with an appropriate time cycle to obtain the the desired thickness of the plating layer. An acid cyanide solution of gold was used as the electroplating solution such as AUTRONEX ®N (Registered trademark of OMI, OXY Metal Industies Corp, Sel-Rex Products). The electroplating solution was preheated to a temperature of 65 degrees Centigrade and was discharged at the rate of 500 ml per minute from the jet nozzle. The deionized water was discharged from its nozzle at the rate of 250 per minute. It should be noted that, if desired, the apparatus of FIGS. 1–2 could be provided with another upstream deionized water discharge to mask the reverse side of the workpiece W. However, the single deionized water mask discharge in coaction with the shield effect of the frontal surface of the workpiece W was found to be effective to mask the reverse side of the workpiece W.

As is apparent to those skilled in the art, while deionized water is preferably used as the low conductivity fluid for the mask, other compatible low conductivity fluids may be used. Moreover, while liquid is the preferred state for the fluid mask, other fluid states such as gas, or mists, vapors, steam or the like may be also employed. Moreover, while the jet and/or the fluid discharge are described with preferred configurations and/or orientations, it should be understood that the invention can be practiced with other configurations and/or orientations and/or combinations thereof.

Thus, while the invention has been described with reference to preferred embodiments thereof, it will be understood by those skilled in the art that various changes in form and details may be made without departing from the scope of the invention.

We claim:

1. In a method for selectively electroplating a workpiece by a jet of plating solution, the steps comprising:
- electroplating a selected region of said workpiece by impinging said jet on said selected region, and
- concurrently providing a layer of fluid of low conductivity and in a predetermined fluid state on said workpiece adjacent to said selected region to mask said workpiece adjacent to said selected region from said electroplating solution, and wherein said fluid layer is further contiguous over said selected region in the absence of said impinging jet, and said jet pierces said layer to expose said region for said impinging and said electroplating.

2. The method of claim 1 wherein said said fluid state is liquid.

3. The method according to claim 1 wherein said fluid layer further carries off the runoff of said plating solution from said jet.

4. The method according to claim 1 wherein said fluid layer is continuously flowing on said workpiece adjacent to said selected region.

5. The method according to claim 1 wherein said fluid is deionized water.

6. The method according to claim 1 wherein said solution comprises a precious metal.

7. In a method for selectively electroplating a workpiece by a jet of plating solution, the steps comprising:
- electroplating a selected region of said workpiece by impinging said jet on said selected region, and
- concurrently continually flowing a layer of deionized water in a predetermined fluid state on said workpiece adjacent to said selected region to mask said workpiece adjacent to said selected region from said electroplating solution, and wherein said continuously flowing layer of deionized water is further contiguous over said selected region in the absence of said impinging jet, and said jet pierces said layer to expose said region for said impinging and said electroplating.

8. The method of claim 7 wherein said said fluid state is liquid.

9. The method according to claim 7 wherein said layer of deionized water further carries off the runoff of said plating solution from said jet.

10. In a method for selectively electroplating at least one surface of a workpiece by a jet of plating solution, the steps comprising:
- coating said surface of said workpiece with a layer of deionized water, and
- subsequently impinging said jet of said plating solution on said layer to pierce said layer and exclusively plate the underlying portion of said surface exposed by the impinging said jet, the remainder of said layer masking the unexposed portions of said surface.

11. The method according to claim 10 wherein said layer of deionized water further carries off the runoff of said plating solution from said jet.

* * * * *